US007928920B2

(12) United States Patent
Yagi

(10) Patent No.: US 7,928,920 B2
(45) Date of Patent: Apr. 19, 2011

(54) FILM ANTENNA AND ELECTRONIC EQUIPMENT

(75) Inventor: Shigeru Yagi, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 391 days.

(21) Appl. No.: 12/117,042

(22) Filed: May 8, 2008

(65) Prior Publication Data

US 2008/0284662 A1 Nov. 20, 2008

(30) Foreign Application Priority Data

May 17, 2007 (JP) ..... 2007-131729

(51) Int. Cl.
*H01Q 9/16* (2006.01)

(52) U.S. Cl. ..... 343/793; 343/702; 343/873; 343/820

(58) Field of Classification Search ..... 343/793, 343/795, 702, 700 MS, 872, 873, 820
See application file for complete search history.

(56) References Cited

U.S. PATENT DOCUMENTS

| | | | | |
|---|---|---|---|---|
| 5,926,150 | A | 7/1999 | McLean et al. | |
| 6,421,014 | B1 | 7/2002 | Sanad | |
| 6,529,170 | B1 | 3/2003 | Nishizawa et al. | |
| 6,600,448 | B2 | 7/2003 | Ikegaya et al. | |
| 6,621,464 | B1 | 9/2003 | Fang et al. | |
| 6,847,328 | B1 | 1/2005 | Libonati et al. | |
| 6,853,336 | B2 * | 2/2005 | Asano et al. | 343/702 |
| 6,870,504 | B2 | 3/2005 | Ikegaya et al. | |
| 6,917,333 | B2 | 7/2005 | Ikegaya et al. | |
| 7,176,843 | B2 | 2/2007 | Shimasaki et al. | |
| 7,248,224 | B2 | 7/2007 | Yuanzhu | |
| 7,265,720 | B1 | 9/2007 | Ponce De Leon et al. | |
| 7,372,406 | B2 | 5/2008 | Shiotsu et al. | |

(Continued)

FOREIGN PATENT DOCUMENTS

DE 101 47 921 A1 4/2003

(Continued)

OTHER PUBLICATIONS

U.S. Appl. No. 12/011,952; First Named Inventor: Shigeru Yagi; Title: "Plane Circular Polarization Antenna and Electronic Apparatus"; Filed: Jan. 30, 2008, published as US 2008/0180339, and issued as USP 7,777,682.

(Continued)

*Primary Examiner* — Douglas W Owens
*Assistant Examiner* — Dieu Hien T Duong
(74) *Attorney, Agent, or Firm* — Holtz, Holtz, Goodman & Chick, PC

(57) ABSTRACT

A film antenna comprises a base film formed of an insulating material; and first and second antenna elements of film-like electric conductors formed on the base film, wherein each of the first and second antenna elements is a planar shape in which two end faces from a feed point to a tip have two different lengths or a planar shape in which an end face and a diagonal line from a feed point to a tip have two different lengths, a core wire of a coaxial cable is connected to the first antenna element at the feed point, an external conductor of the coaxial cable is connected to the second antenna element at the feed point, and the first and second antenna elements have an area as a capacitor for performing impedance matching.

14 Claims, 6 Drawing Sheets

U.S. PATENT DOCUMENTS

| | | | | |
|---|---|---|---|---|
| 7,375,686 | B2 | 5/2008 | Ku et al. | |
| 7,389,129 | B2 | 6/2008 | Shoji | |
| 7,423,598 | B2 * | 9/2008 | Bit-Babik et al. | 343/702 |
| 7,612,720 | B2 | 11/2009 | Kerselaers | |
| 7,777,682 | B2 | 8/2010 | Yagi | |
| 2003/0045324 | A1 | 3/2003 | Nagumo et al. | |
| 2004/0137971 | A1 | 7/2004 | Shoji | |
| 2004/0201528 | A1 | 10/2004 | Lee et al. | |
| 2004/0217916 | A1 | 11/2004 | Quintero Illera et al. | |
| 2004/0222936 | A1 | 11/2004 | Hung et al. | |
| 2004/0246188 | A1 | 12/2004 | Egashira | |
| 2005/0035919 | A1 | 2/2005 | Yang et al. | |
| 2005/0200556 | A1 | 9/2005 | Lin et al. | |
| 2005/0212706 | A1 | 9/2005 | Ying et al. | |
| 2005/0280579 | A1 | 12/2005 | Liang et al. | |
| 2006/0001590 | A1 | 1/2006 | Hung et al. | |
| 2006/0017643 | A1 | 1/2006 | Shimasaki et al. | |
| 2006/0022888 | A1 | 2/2006 | Cheng | |
| 2006/0132362 | A1 | 6/2006 | Yuanzhu | |
| 2006/0170605 | A1 * | 8/2006 | Tang et al. | 343/795 |
| 2006/0187135 | A1 * | 8/2006 | Maniwa et al. | 343/795 |
| 2006/0208950 | A1 | 9/2006 | Tago | |
| 2007/0040751 | A1 | 2/2007 | Boyle | |
| 2007/0052610 | A1 | 3/2007 | Lee | |
| 2007/0103367 | A1 | 5/2007 | Wang | |
| 2007/0268190 | A1 | 11/2007 | Huynh | |
| 2008/0180339 | A1 | 7/2008 | Yagi | |
| 2008/0180342 | A1 | 7/2008 | Kerselaers | |
| 2009/0167619 | A1 | 7/2009 | Yagi | |
| 2009/0295652 | A1 | 12/2009 | Yagi et al. | |

FOREIGN PATENT DOCUMENTS

| | | | |
|---|---|---|---|
| DE | 20 2006 019 045 | U1 | 2/2007 |
| EP | 1 345 282 | A1 | 9/2003 |
| EP | 1 617 514 | A1 | 1/2006 |
| JP | 10-093332 | A | 4/1998 |
| JP | 2001-185938 | A | 7/2001 |
| JP | 2002-055733 | A | 2/2002 |
| JP | 2003-078333 | A | 3/2003 |
| JP | 2004-072605 | A | 3/2004 |
| JP | 2004-159029 | A | 6/2004 |
| JP | 2004-356823 | A | 12/2004 |
| JP | 3622959 | B2 | 2/2005 |
| JP | 2005-130249 | A | 5/2005 |
| JP | 3656610 | B2 | 6/2005 |
| JP | 2005-286915 | A | 10/2005 |
| JP | 2006-067234 | A | 3/2006 |
| JP | 2006-180150 | A | 7/2006 |
| JP | 3830358 | B2 | 10/2006 |
| JP | 2006-529070 | T | 12/2006 |
| JP | 2007-013596 | | 1/2007 |
| JP | 2007-027906 | A | 2/2007 |
| JP | 2007-043594 | A | 2/2007 |
| JP | 2007-124346 | A | 5/2007 |
| WO | WO 01/15270 | A1 | 3/2001 |
| WO | WO 2004/097980 | A1 | 11/2004 |
| WO | WO 2006/114724 | A1 | 11/2006 |

OTHER PUBLICATIONS

U.S. Appl. No. 12/343,989; First Named Inventor: Shigeru Yagi; Title: "Planar Monopole Antenna and Electronic Device"; Filed: Dec. 24, 2008, published as US 2009/0167619.

U.S. Appl. No. 12/473,680; First Named Inventor: Shigeru Yagi; Title: "Planar Antenna and Electronic Device"; Filed: May 28, 2009, published as US 2009/0295652.

U.S. Appl. No. 12/776,583; First Named Inventor: Yuki Kotaka; Title: "Multiband Planar Antenna and Electronic Equipment"; Filed: May 10, 2010.

* cited by examiner

FILM ANTENNA AND ELECTRONIC EQUIPMENT

BACKGROUND OF THE INVENTION

1. Field of the Invention

The present invention relates to a film antenna and an electronic equipment.

2. Description of Related Art

Antennas for wireless communication have been hitherto miniaturized in mobile terminals having a wireless communication function such as handy terminal, PDA (Personal Digital Assistant), etc. Dipole antennas having a large resonance band (broad band) have been considered as antennas for wireless communication in mobile terminals.

An antenna having paired planar isosceles triangle elements which are designed like the shape of wings of a butterfly has been considered (see Patent Document 1: JP-A-2007-27906, for example). That is, the area of the element is increased to obtain a broad band.

Furthermore, as the dipole antenna of the broad band, an antenna having paired short-rod-shaped antenna element and long-rod-shaped antenna element has been considered (for example, see Patent Document 2: JP-A-2007-43594). That is, the antenna has the two rod-shaped elements having different resonance frequencies, which are paired.

However, in the conventional dipole antenna equipped with the elements having the butterfly-wing shape, the length in the vertical direction of each element is increased, and it is difficult to miniaturize the dipole antenna and equipment having the dipole antenna mounted therein.

Furthermore, in the dipole antenna having two paired rod-shaped elements, the impedance thereof is larger than 50[Ω]. Therefore, a balun is required for impedance matching. The balun is an impedance matching device. Accordingly, an area for forming the balun is required, and thus it is difficult to miniaturize the dipole antenna and equipment having the dipole antenna mounted therein.

SUMMARY OF THE INVENTION

It is, therefore, a main object of the present invention to implement a broad-band antenna that can be easily miniaturized.

According to a first aspect of the present invention, there is provided a film antenna comprising: a base film formed of an insulating material; and first and second antenna elements of film-like electric conductors formed on the base film, wherein each of the first and second antenna elements is a planar shape in which two end faces from a feed point to a tip have two different lengths or a planar shape in which an end face and a diagonal line from a feed point to a tip have two different lengths, a core wire of a coaxial cable is connected to the first antenna element at the feed point, an external conductor of the coaxial cable is connected to the second antenna element at the feed point, and the first and second antenna elements have an area as a capacitor for performing impedance matching.

According to a second aspect of the present invention, there is provided a electronic equipment comprising: a film antenna including: a base film formed of an insulating material, and first and second antenna elements of film-like electric conductors formed on the base film, wherein each of the first and second antenna elements is a planar shape in which two end faces from a feed point to a tip have two different lengths or a planar shape in which an end face and a diagonal line from a feed point to a tip have two different lengths, a core wire of a coaxial cable is connected to the first antenna element at the feed point, an external conductor of the coaxial cable is connected to the second antenna element at the feed point, and the first and second antenna elements have an area as a capacitor for performing impedance matching; a communication unit that performs communication with an external equipment through the film antenna; and a control unit that controls the communication of the communication unit using the film antenna.

According to the present invention, it is possible to implement a broad-band antenna that can be easily miniaturized.

DESCRIPTION OF THE PREFERRED EMBODIMENT

In the following, an embodiment of the present invention will be described with reference to the attached drawings. The following descriptions and the attached drawings pertain to the embodiment of the present invention are not intended to limit the present invention.

Figure 1C:
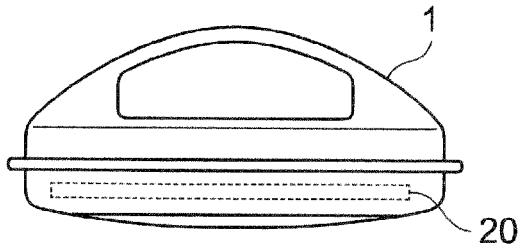
FIG. 1C is an upper view showing the handy terminal.
Figure 1B:
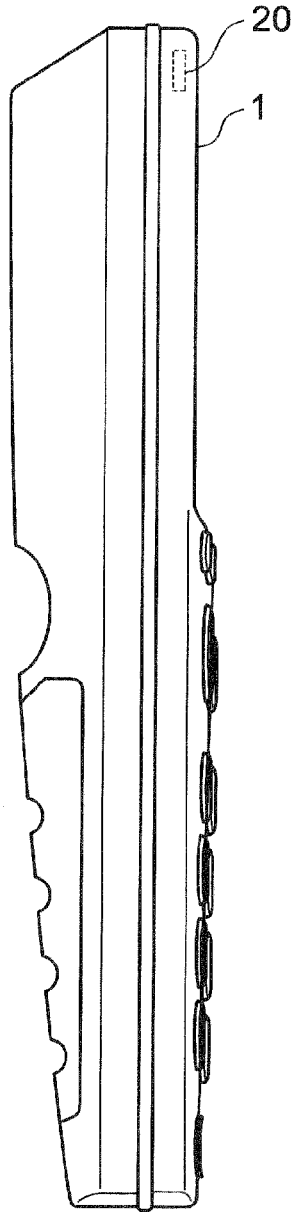
FIG. 1B is a side view of the handy terminal.
Figure 1A:
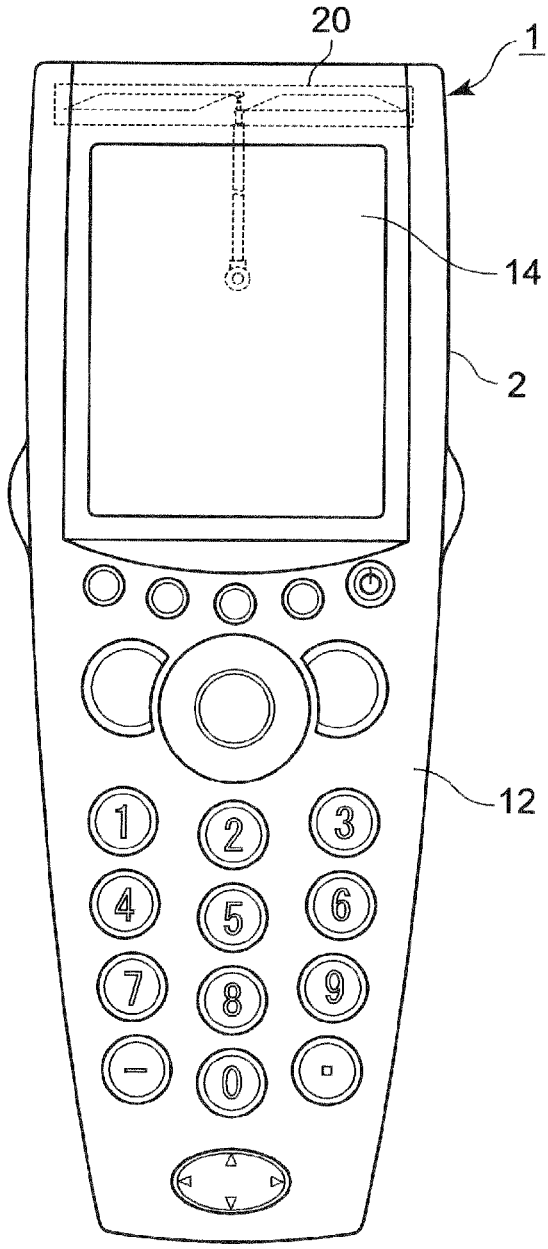
FIG. 1A is a front view showing a handy terminal according to an embodiment of the present invention.

An embodiment according to the present invention will be described with reference to FIGS. 1A to 12. First, the construction of a device according to this embodiment will be described with reference to FIGS. 1A to 6. FIG. 1A is a front view showing the construction of a handy terminal 1 according to the embodiment. FIG. 1B is a side view showing the construction of the handy terminal 1. FIG. 1C is a top view showing the construction of the handy terminal 1.

The handy terminal 1 as electronic equipment according to this embodiment is a mobile terminal having functions of inputting, storing information, etc. according to a user's operation. Particularly, the handy terminal 1 has a function of performing wireless communication with external equipment through an access point according to a wireless LAN (Local Area Network) system.

As shown in FIGS. 1A, 1B, and 1C, the handy terminal 1 is constructed to have an input unit 12, a display unit 14, etc. on a case 2, and also have a film antenna 20, a board, etc. in the case 2. The film antenna 20 is a dipole antenna for performing the wireless (LAN) communication.

Figure 2:
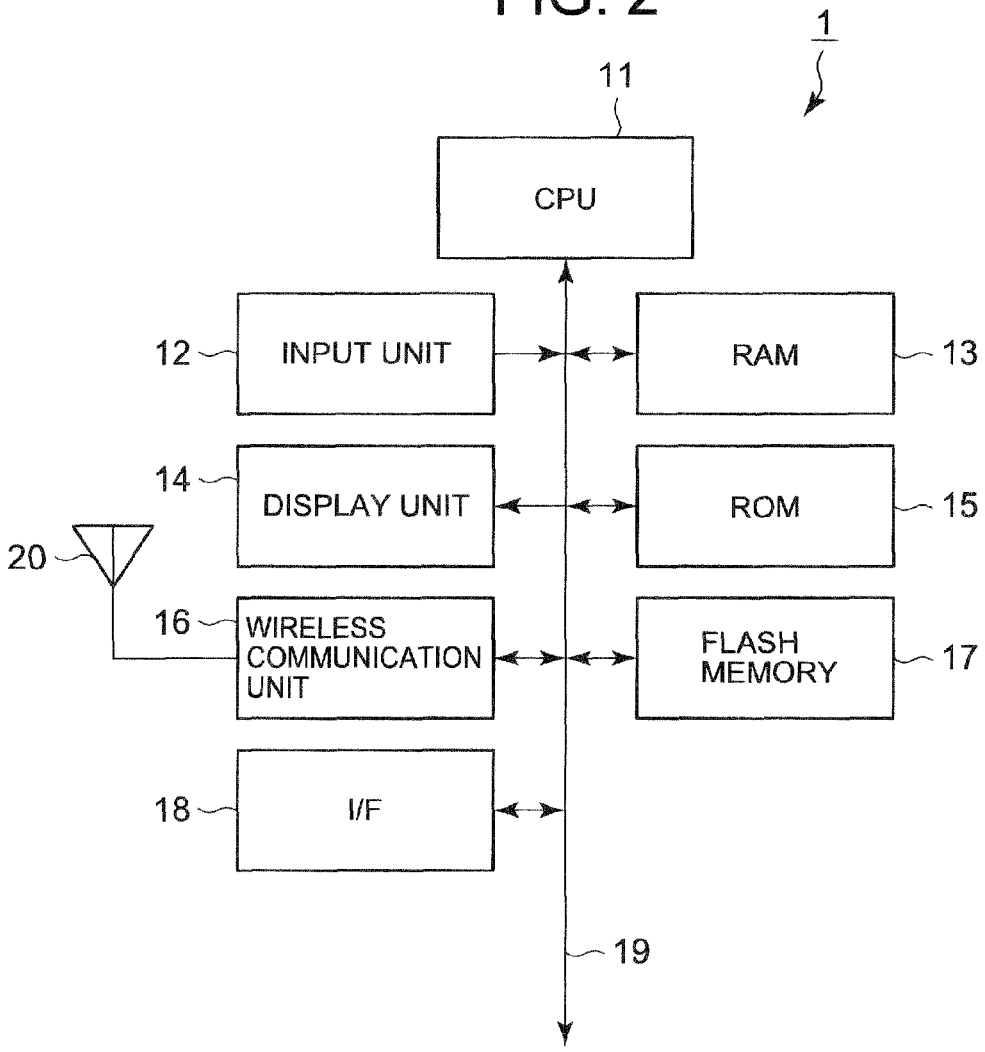
FIG. 2 is a block diagram showing the internal construction of the handy terminal.

FIG. 2 shows the internal construction of the handy terminal 1. As shown in FIG. 2, the handy terminal 1 is equipped with CPU (Central Processing Unit) 11 as a control unit, an input unit 12, RAM (Random Access Memory) 13, a display unit 14, ROM (Read Only Memory) 15, a wireless communication unit 16 as a communicating unit having a film antenna 20, a flash memory 17, I/F (Inter Face) 18, etc., and these units are connected to one another through a bus 19.

CPU 11 concentrically controls the respective units of the handy terminal 1. CPU 11 develops an indicated program from a system program and various kinds of application programs stored in ROM 15 into RAM 13, and executes various kinds of processing in cooperation with the program developed in RAM 13.

In cooperation with various kinds of programs, CPU 11 accepts an input of operation information through the input unit 12, reads out various kinds of information from ROM 15, reads/writes various kinds of information from/into the flash memory 17, performs wireless communication with external equipment through the wireless communication unit 16 and the film antenna 20 and performs wire-communication with external equipment through I/F 18.

The input unit 12 is equipped with a keypad having a cursor key, numeric keys, various kinds of function keys, etc., and outputs an input signal of each key which is downwardly pushed by an operator. The input unit 12 may be integrated with the display unit 14 to construct as a touch panel.

RAM 13 is a volatile memory, and it has a work area for storing various kinds of programs to be executed, data associated with the various kinds of programs, etc. and temporarily stores information. The display unit 14 is constructed by LCD (Liquid Crystal Display), ELD (ElectroLuminescent Display) or the like, and performs screen display according to a display signal from CPU 11.

ROM 15 is a storage unit for storing information of various kinds of data in a read-only style in advance.

The wireless communication unit 16 is connected to the film antenna 20, and transmits/receives information to/from external equipment using the film antenna 20 and through an access point or the like according to the wireless LAN system. In this embodiment, the description will be made in a case where wireless LAN communication of 2.4 [GHz] band in frequency band will be described as an example of wireless communication. However, the present invention is not limited to this, and wireless LAN communication of another frequency band such as 5.2 [GHz] band in frequency band or the like, another communication type wireless communication may be used as the wireless communication.

The flash memory 17 is a storage unit from/into which information of various kinds of data can be read/written. I/F 18 transmits/receives information with external equipment through a communication cable. I/F 18 is a wire-communication unit of USB (Universal Serial Bus) system.

Figure 3:
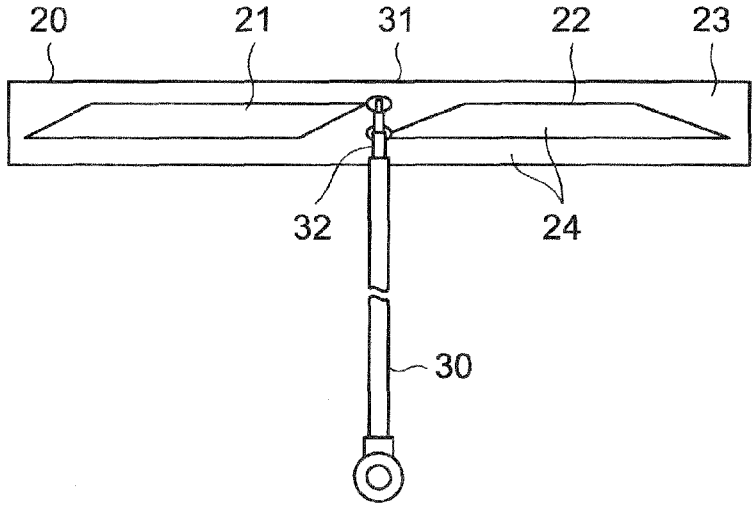
FIG. 3 is a diagram showing the construction of a film antenna.

FIG. 3 shows the construction of the film antenna 20. As shown in FIG. 3, the film antenna 20 is equipped with an antenna element 21 as a first antenna element, an antenna element 22 as a second antenna element, a base film 23 and an insulating protection sheet 24, and these are connected to the coaxial cable 30.

The antenna element 21 is formed of copper foil as an electrical conductor, and it has a trapezoidal (substantially parallelogram) shape. The antenna element 22 is formed of copper foil as an electrical conductor, and it has a trapezoidal (substantially parallelogram) shape. However, the materials of the antenna elements 21, 22 are not limited to copper foil. The base film 23 is formed of polyimide as insulator. However, the material of the base film 23 is not limited to polyimide. The antenna elements 21, 22 are pattern-formed on the base film 23. Furthermore, an insulating protection sheet 24 is formed on the antenna elements 21, 22, and they are protected from being short-circuited to external parts.

The coaxial cable 30 has a core wire 31 of an electrical conductor and an external conductor 32 of an electrical conductor of mesh type or the like, which are insulated from each other. The core wire 31 at one end of the coaxial cable 30 is connected to the antenna element 21 by soldering. The external conductor 32 at the one end of the coaxial cable 30 is connected to the antenna element 22 by soldering. The connection points of the antenna elements 21, 22 to the coaxial cable 30 are set as feeding points. The other end of the coaxial cable 30 is connected to the wireless communication unit 16 on the board of the handy terminal 1.

The wavelength of an electromagnetic wave having a communication target frequency in the wireless communication is represented by wavelength P. In this case, the size in the longitudinal direction of each of the antenna elements 21, 22 is equal to (¼)λ. This principle will be described later.

Figure 4:
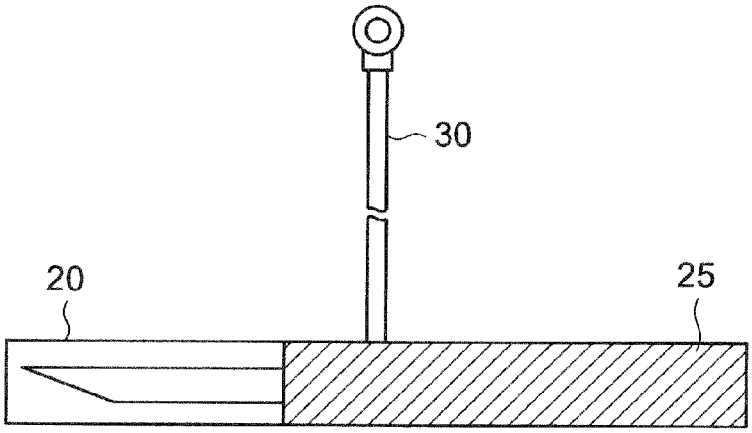
FIG. 4 is a diagram showing the film antenna to which a rubber sheet is attached.

FIG. 4 shows the film antenna 20 to which a rubber sheet 25 is attached. As shown in FIG. 4, the film antenna 20 has the rubber sheet 25 as a dielectric sheet. The rubber sheet 25 is attached on a surface side of the antenna-elements 21, 22 formed on the base film 23. The rubber sheet 25 may be attached to the back surface side of the base film 23 opposite to the surface side of the antenna-elements 21, 22 formed on the base film 23. Furthermore, the rubber sheet 25 may be attached to both the surface side of the antenna-element 21, 22 formed on the base film 23 and the back surface of the base film opposite to the surface side of the antenna-elements 21, 22 surface.

The rubber sheet 25 functions as a dielectric material. Therefore, the length in the longitudinal direction of the film antenna 20 is shortened in accordance with the dielectric constant of the rubber sheet 25. The effect of shortening the length in the longitudinal direction of the antenna elements 21, 22 by the dielectric constant of the rubber sheet with respect to the wavelength of the target frequency is represented by the following equation (1) using the dielectric constant $\epsilon_{eff}$.

$$1/(\epsilon_{eff})^{1/2} \quad (1)$$

The rubber sheet 25 also functions as an insulator. When the film antenna 20 is actually mounted in the housing (the case 2, etc.) of the handy terminal 1, other parts can be prevented from interfering with the antenna elements 21, 22, the core wire 31 and the external conductor 32 by the rubber sheet 25. Particularly, it is preferable that the rubber sheet 25 is attached to the base film 23, etc. so as to cover the core wire 31, the external conductor 32 and the soldered portions thereof at which the conductor portions are bared. Furthermore, the film antenna 20 itself can be stably mounted (backlash is prevented) by the rubber sheet 25.

Figure 5:
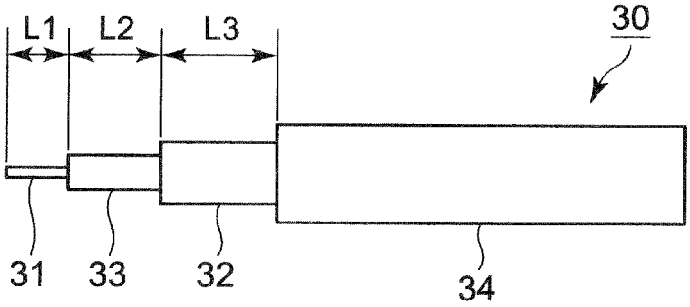
FIG. 5 is a diagram showing the construction of a coaxial cable.

FIG. 5 shows the construction of the coaxial cable 30. As shown in FIG. 5, the coaxial cable 30 is equipped with the core wire 31, an insulator 33 of polyethylene or the like, the external conductor 32 and a protection coating 34 as an insulator which are concentrically arranged in this order from the center of the axis to the outside.

In the coaxial cable 30, the length of the bared core wire 31 at the fixing side of the film antenna 20 is represented by L1. Likewise, in the coaxial cable 30, the length of the bared insulator 33 at the fixing side of the film antenna 20 is represented by L2. Likewise, in the coaxial cable 30, the length of the bared external conductor 32 at the fixing side of the film antenna 20 is represented by L3.

Figure 6:
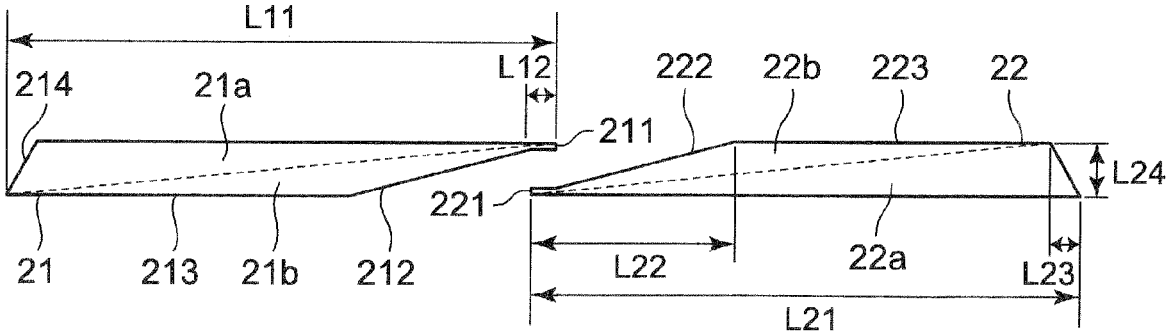
FIG. 6 is a diagram showing an antenna element and the arrangement thereof.

FIG. 6 shows the antenna elements 21, 22 and the arrangement thereof. As shown in FIG. 6, the antenna element 21 has an overlap portion 211, a slant portion 212, a parallel portion 213 and a slant portion 214 which are disposed in this order from the connection point of the coaxial cable 30. The antenna element 22 has an overlap portion 221, a slant portion 222, a parallel portion 223 and a slant portion 224 which are disposed in this order from the connection point of the coaxial cable 30. The overlap portion 211 is connected to the core wire 31 by soldering. The overlap portion 221 is connected to the external conductor 32 by soldering.

The longitudinal directions of the antenna elements 21, 22 are the same direction. The overlap portions 211, 221 are arranged on a line vertical to the longitudinal direction of the film antenna 20 (the antenna elements 21, 22). Therefore, the longitudinal direction of the antenna elements 21, 22 and the axial direction of the coaxial cable 30 are vertical to each other. Accordingly, the film antenna 20 can be easily and stably mounted in the housing of the handy terminal 1.

In the antenna element 21, a substantial parallelogram is defined by the slant portion 212, the parallel portion 213 and the slant portion 214. In the antenna element 22, a trapezoid is defined by the slant portion 222, the parallel portion 223 and the slant portion 224.

Each length in the longitudinal direction of the film antenna 20 will be described. The whole length in the longitudinal direction of the antenna element 21 is represented by L11. The whole length in the longitudinal direction of the antenna element 22 is represented by L21. The length (in the longitudinal direction of the antenna element 21) of the overlap portion 211 is represented by L12. For example, the length (in the longitudinal direction of the antenna element 22) of the overlap portion 221 is also represented by L12, however, the present invention is not limited to these lengths.

The length in the longitudinal direction of the overlap portion 221 and the slant portion 222 of the antenna element 22 is represented by L22 For example, the length in the longitudinal direction of the overlap portion 211 and the slant portion 212 of the antenna element 21 is also represented by L22, however, it is not limited to this value. Furthermore, the length in the longitudinal direction of the slant portion 224 of the antenna element 22 is represented by L23. For example, the length in the longitudinal direction of the slant portion 214 of the antenna element 21 is represented by L23, however, it is not limited to this value. Furthermore, the length in the short direction of the antenna element 22 (parallel portion 223) is represented by L24. For example, the length in the short direction of the antenna element 21 is also represented by L24, however, it is not limited to this value.

The length between the overlap portion 211 and the overlap portion 221 corresponds to the length L2 of the insulator 33 of FIG. 5. With respect to the length L11 and the length L21 of the antenna elements 21, 22, they are set so as to satisfy the following equation (2) by using the length L2 in FIG. 5.

$$L11+L2=L21 \quad (2)$$

Furthermore, an upper portion obtained by sectioning the antenna element 21 with a diagonal line (dotted line in FIG. 6) from the overlap portion 211 serving as the feed point to the tip of the antenna element 21 is defined as a triangular portion 21*a*, and a lower portion is defined as a triangular portion 21*b*. Likewise, a lower portion obtained by sectioning the antenna element 22 with a diagonal line (dotted line in FIG. 6) from the overlap portion 221 serving as the feed point to the tip of the antenna element 22 is defined as a triangular portion 22*a*, and an upper portion is defined as a triangular portion 22*b*. As described later, in principle, the antenna element functions by using only the triangular portions 21*a*, 22*a*. However, the triangular portions 21*b*, 22*b* are provided to expand the width of the overlap portions 211, 221 (in the longitudinal direction and the vertical direction of the antenna elements 21, 22).

Figure 7:
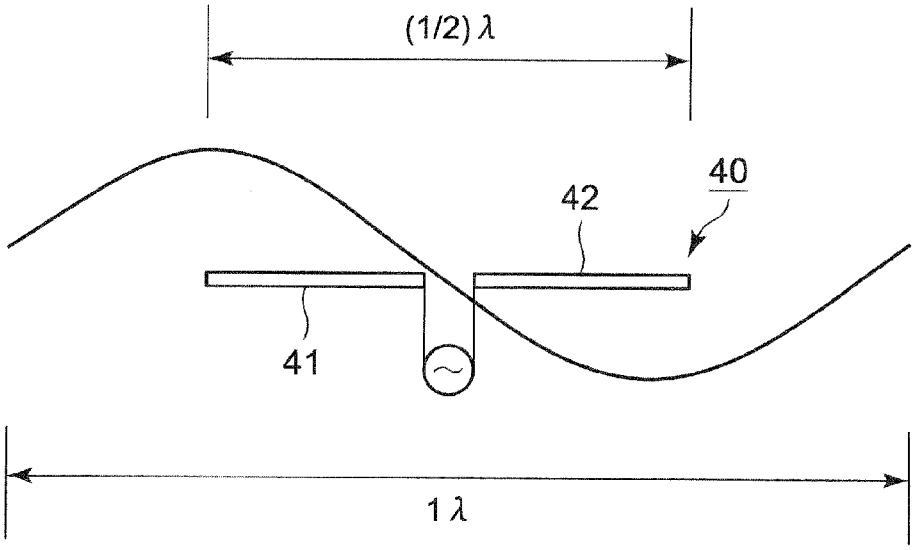
FIG. 7 is a general dipole antenna.

Next, the operation principle of the film antenna 20 will be described. FIG. 7 shows a general dipole antenna 40. First, as shown in FIG. 7, two rod-shaped dipole antennas 40 as a base of the film antenna 20 are considered.

The dipole antenna 40 has rod-shaped antenna elements 41, 42. The antenna elements 41, 42 are arranged linearly in this order. As in the case of the antenna elements 21, 22, the core wire and the external conductor of the coaxial cable are connected to each of the end portions of the antenna elements 41, 42. The connection point thereof is represented by a feed point 30A.

The wavelength of electromagnetic wave of a communication target frequency (band) in the wireless communication is represented by wavelength A. When the length in the longitudinal direction of the antenna elements 41, 42 is equal to $(1/2)\lambda$, the dipole antenna 40 resonates and the wireless communication is performed excellently. Therefore, it is preferable that the length in the longitudinal direction of the dipole antenna 40 is set to $(1/2)\lambda$.

Figure 8:
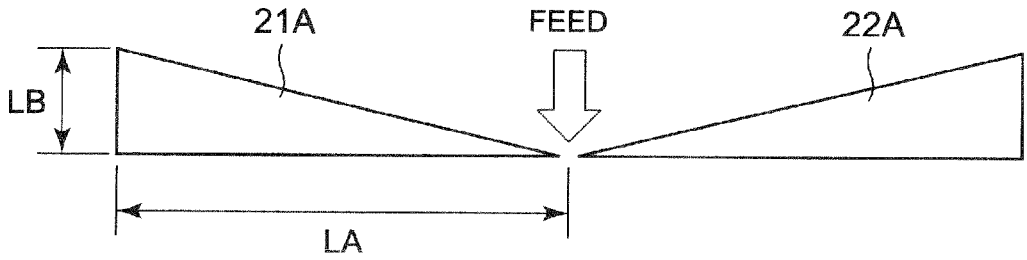
FIG. 8 shows the construction of a planar antenna.
Figure 9:
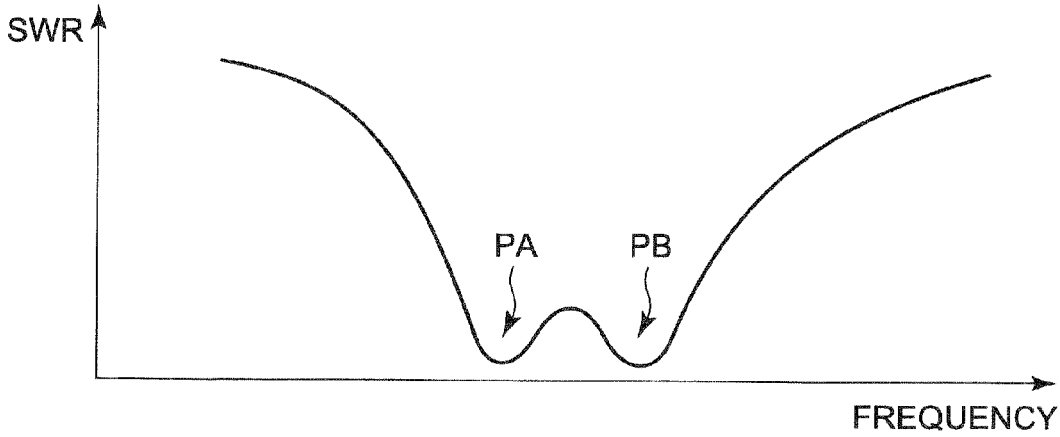
FIG. 9 is a diagram showing SWR with respect to the frequency of the planar antenna of FIG. 8.

FIG. 8 shows the construction of the antenna elements 21A, 22A of the planar antenna. FIG. 9 shows SWR (Standing Wave Ratio) with respect to the frequency of the planar antenna of FIG. 8.

In the antenna elements 21A, 22A of the planar antenna shown in FIG. 8, the length of the side in the longitudinal direction of the antenna element 21A is represented by LA, and the length of the side in the short direction of the antenna element 21A is represented by LB. The long side of the antenna element 21A is represented by $(LA^2+LB^2)^{1/2}$. The same is applied to the antenna element 22A.

When the communication target frequency band is the GHz band, antenna current flowing in the antenna elements 21A, 22A concentrates to an edge portion (end face and surface) by a skin effect. Therefore, the antenna elements 21A, 22A actually functions as a dipole antenna which corresponds to an element corresponding to the side of the length LA and an element corresponding to the side of the length $(LA^2+LB^2)^{1/2}$.

As shown in FIG. 9, it is found that two resonance points PA, PB having low SWP appear in the frequency characteristic of SWR of the antenna elements 21A, 22A. The resonance point PA corresponds to the side of the length $(LA^2+LB^2)^{1/2}$ of the antenna elements 21A, 22A. The resonance point PB corresponds to the side of the length LA of the antenna elements 21A, 22A. The resonance points PA and PB are set and combined in a band in which the length LA and the length $(LA^2+LB^2)^{1/2}$ are proximate to each other, whereby the resonance band width as the overall antenna can be increased and a dipole antenna having a broad band can be formed.

The antenna element 21A corresponds to the triangular portion 21*a* of the antenna element 21 of the film antenna 20.

The antenna element 22A corresponds to the triangular portion 22*a* of the antenna element 22 of the film antenna 20. Therefore, the film antenna 20 is also an antenna having a broad band width. Furthermore, when the antenna elements 21, 22 have the triangular portions 21*b*, 22*b* in addition to the triangular portions 21*a*, 22*a*, they are likewise designed to have a broad band width.

Figure 10:
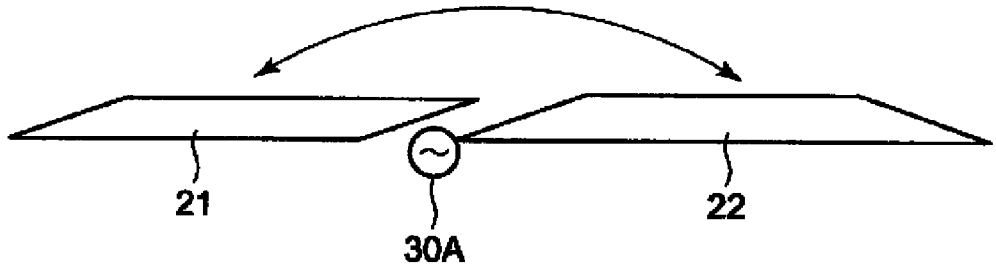
FIG. 10 is a diagram showing the antenna element.

Next, the principle that the film antenna 20 functions as a capacitor will be described. FIG. 10 shows the antenna elements 21, 22.

As shown in the dipole antenna 40 shown in FIG. 7, the impedance of the dipole antenna when the two antenna elements are opened by 180° is theoretically equal to 73[Ω]. However, it is required to match this impedance with 50[Ω] which is the impedance at the feed point (impedance matching). It has been hitherto to perform impedance matching by providing a balun.

In order to perform the impedance matching without providing any balun, it is necessary to provide a capacitor component in parallel to the dipole antenna. The electrical capacitance of the capacitor is required to be 0.4 [pF]. In the film antenna 20, the antenna elements 21, 22 functions as a capacitor using air as dielectric material. Specifically, it is assumed that air is filled as a medium between the antenna elements 21 and 22 as represented by a double-side arrow of FIG. 10. Attention is also paid to the rubber sheet 25 and the dielectric constant thereof.

The electrical capacitance of the capacitor of the antenna elements 21, 22 is determined by the area of the antenna elements 21, 22. Therefore, the impedance matching is performed by adjusting this area. For example, by providing the triangular portions 21*b*, 22*b*, the area of the antenna elements 21, 22 can be adjusted to make the area broad.

As described above, since no balun is provided, the film antenna 20 can be miniaturized. Therefore, as shown in FIGS. 1A to 1C, the film antenna 20 can be easily mounted at a width-limited portion such as the tip portion of the case 2 or the like of the handy terminal 1.

Figure 11:
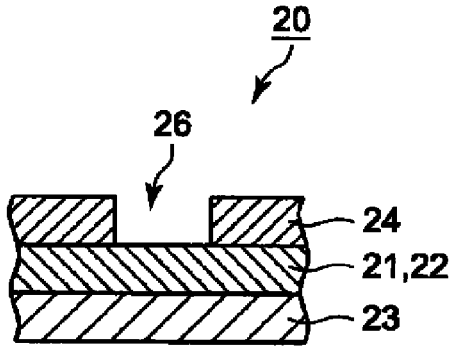
FIG. 11 is a cross-sectional view showing the film antenna.

Next, a method of manufacturing the film antenna 20 will be described with reference to FIG. 11. FIG. 11 is a cross-sectional view of the film antenna 20.

As shown in FIG. 11, in the film antenna 20, the antenna elements 21, 22 are formed on the base film 23, and the insulating protection sheet 24 is formed on the antenna elements 21, 22.

In the insulating protection sheet 24, a hole portion(s) 26 is provided at the connection portion between the overlap portion 211 of the antenna element 21 and the core wire 31 of the coaxial cable 30 and at the connection portion between the overlap portion 221 of the antenna element 22 and the outer conductor 32 of the coaxial cable 30. The hole portion 26 serves as a pad portion of soldering.

As described above, the core wire 31 and the outer conductor 32 of the coaxial cable 30 are soldered to the sheet on which the base film 23, the antenna elements 21, 22 and the insulating protection sheet 24 having the hole portion 26 are formed. The soldering position can be fixed to a specific accurate position by the insulating protection sheet 24 having the hole portion 26. Therefore, the dispersion of the antenna characteristic due to dispersion of the soldering position can be reduced.

Figure 12:
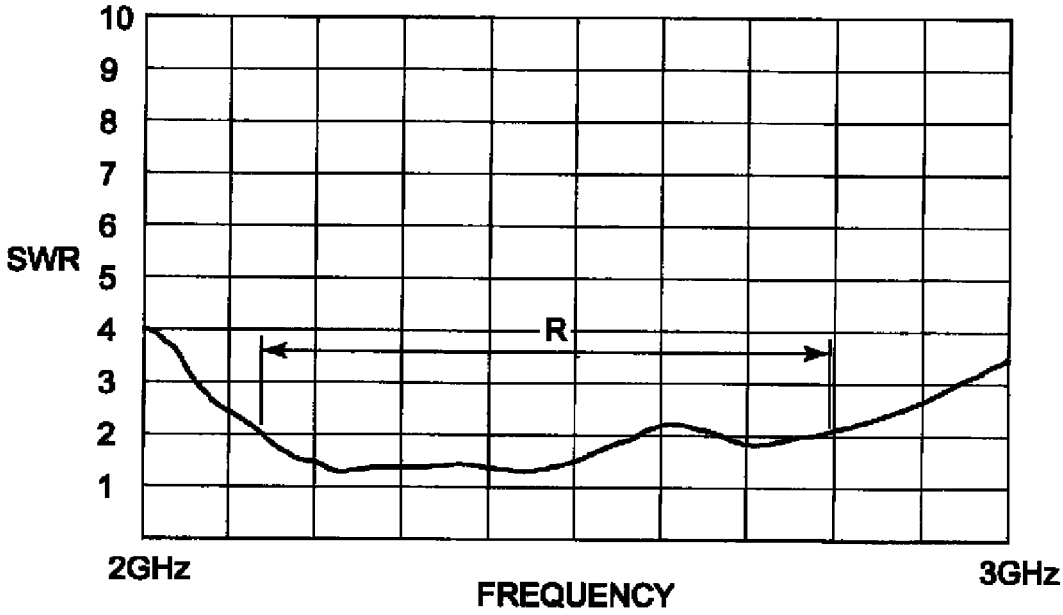
FIG. 12 is a diagram showing SWR with respect to the frequency of the film antenna.

Next, the antenna characteristic of the film antenna 20 will be described. FIG. 12 shows SWR with respect to the frequency of the film antenna 20.

As shown in FIG. 12, with respect to the film antenna 20, SWR in frequencies from 2 [GHz] to 3 [GHz] was measured. The communication target frequency band was set to 2.4 [GHz] band. As a testing standard, it is required that SWR is equal to 2 or less and SWR is constant in a band of 2400 [MHz] to 2500 [MHz]. In a measurement result of FIG. 12, SWR is equal to 2 or less and SWR is constant in a band from 2150 [MHz] to 2800 [MHz]. Therefore, a broad-band antenna characteristic from 2150 [MHz] to 2800 [MHz] was obtained with respect to the film antenna 20.

As described above, according to this embodiment, the film antenna 20 has the planar antenna elements 21, 22 each having to two different lengths at the end face from the feed point to the tip (the upper side of the antenna element 21, the lower side of the antenna element 22) and the diagonal line (the dotted line of FIG. 6). Therefore, the length L24 in the short direction of the antenna elements 21, 22 can be reduced, and the broad-band film antenna 20 which can be easily miniaturized can be implemented.

Furthermore, the antenna elements 21, 22 function as a capacitor through air, and the area thereof is adjusted to establish impedance matching. Therefore, it is unnecessary to provide a part such as a balun or the like for the impedance matching, and thus the film antenna 20 can be further miniaturized.

Furthermore, the rubber sheet 25 is attached to the surfaces of the antenna elements 21, 22. Therefore, the connection portion (feed point) between the antenna element 21, 22 and the coaxial cable 30 can be prevented from being short-circuited to an external part, and also the film antenna 20 can be stably mounted in the case 2 without backlash.

Furthermore, the insulating protection sheet 24 is provided on the surfaces of the antenna elements 21, 22. Therefore, the antenna elements 21, 22 can be prevented from being short-circuited to an external part.

The insulating protection sheet 24 has the hole portion 26 corresponding to a position of the feed point at the portion at which the antenna elements 21, 22 and the coaxial cable 30 are soldered. Therefore, the soldering between the antenna elements 21, 22 and the coaxial cable 30 can be performed at an accurate position, and the dispersion of the antenna characteristic can be reduced and the antenna characteristic can be stabilized in the process of manufacturing the film antenna 20.

The antenna elements 21, 22 have the overlap portions 211, 221 corresponding to the respective feed point positions arranged on the line vertical to the longitudinal direction of the antenna elements 21, 22. Therefore, the coaxial cable 30 can be connected to the antenna elements 21, 22 while the axial direction of the coaxial cable 30 is set to be vertical to the longitudinal direction of the antenna elements 21, 22. Accordingly, the film antenna 20 can be easily manufactured, and the manufacturing efficiency can be enhanced. Furthermore, the manufacturing dispersion can be reduced.

The length L11 of the antenna element 21 is shorter than the length L21 of the antenna element 22 by the amount corresponding to the length L2 of the bared insulator 33 of the coaxial cable 30. Therefore, the mismatching caused by the terminal treatment (the terminal treatment of the coaxial cable for fixing) in the film antenna 20 can be prevented.

Furthermore, the material of the base film 23 is formed of polyimide. Therefore, the base film 23 can be constructed with the characteristic thereof being made excellent. Furthermore, the materials of the antenna elements 21, 22 are copper foil. Therefore, the antenna elements 21, 22 can be constructed with the characteristic thereof being made excellent.

Furthermore, the handy terminal 1 has the wireless communication unit 16 having the film antenna 20, and CPU 11 for controlling the wireless communication unit 16. Therefore, the handy terminal 1 can perform broad-band communications by using the film antenna 20, and also the handy terminal 1 can be miniaturized.

(Modification)

Figure 13A:
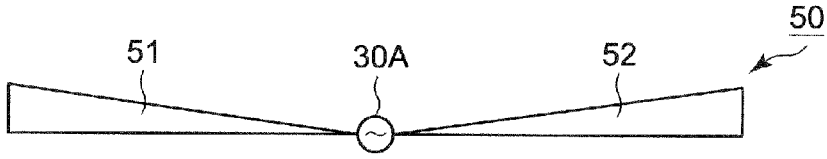
FIG. 13A is a diagram showing the construction of a film antenna according to a modification.
Figure 13B:
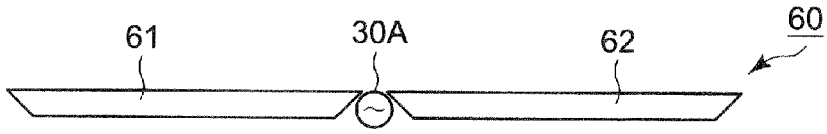
FIG. 13B is a diagram showing the construction of a film antenna according to another modification.
Figure 13C:
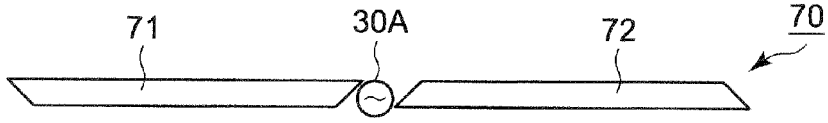
FIG. 13C is a diagram showing the construction of a film antenna according to another modification.
Figure 13D:
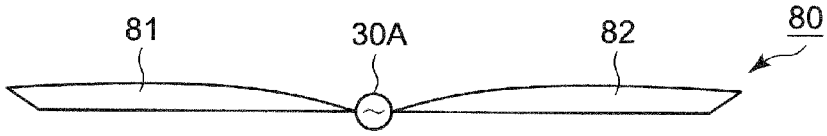
FIG. 13D is a diagram showing the construction of a film antenna according to another modification.
Figure 13E:
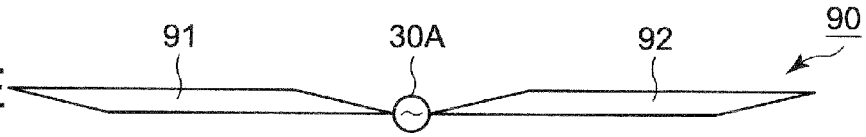
FIG. 13E is a diagram showing the construction of a film antenna according to another modification.
Figure 13F:
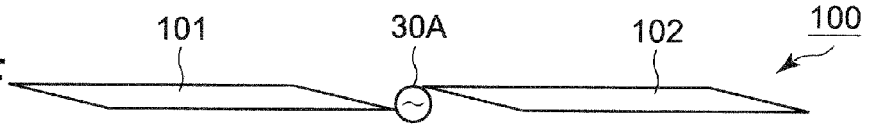
FIG. 13F is a diagram showing the construction of a film antenna according to another modification.

A modification of the above embodiment will be described with reference to FIGS. 13A to 13F. FIG. 13A shows the construction of a film antenna 50. FIG. 13B shows the construction of a film antenna 60. FIG. 13C shows the construction of the film antenna 70. FIG. 13D shows the construction of a film antenna 80. FIG. 13E shows the construction of a film antenna 90. FIG. 13F shows the construction of a film antenna 100.

In the above embodiment, the combination construction of the trapezoid (substantially parallelogram) and the trapezoid (substantially isosceles trapezoid) is described as a pair of antenna elements. However, the present invention is not limited to this shape. For example, a film antenna 50 as shown in FIG. 13A may be adopted. The film antenna 50 has antenna elements 51, 52 having the same triangular shape. The antenna elements 51, 52 are arranged so that the feed point 30A is located therebetween. In the film antenna 50, the antenna elements 51, 52 are designed to be located at the same position (height) at the feed point 330A side.

In this construction, the respective feed points of the antenna elements 51, 52 are arranged to be located at right and left sides along the longitudinal direction of the antenna elements 51, 52. A terminal treatment for arranging the core wire and the external conductor of the coaxial cable to the right and left sides is executed. For example, the core wire is arranged to the left side, the external conductor is arranged to the right side, the core wire is soldered to the feed point of the antenna element 51, and the external conductor is soldered to the feed point of the antenna element 52. By the connection described above, the connection can be performed while the axial direction of the coaxial cable excluding the soldering portion of the coaxial cable is vertical to the longitudinal direction of the antenna elements 51, 52.

Furthermore, for example, the antenna elements 51, 52 themselves may be displaced in the vertical direction and arranged so as to be overlapped with each other in the vertical direction at the feed point 30A side. By the connection as described above, the connection can be performed while the axial direction of the coaxial cable is vertical to the longitudinal direction of the antenna elements 51, 52. The construction of the film antenna 50 described above is applied in the following other film antenna in which the feed point 30A sides of the two antenna elements are located at the same position.

A film antenna 60 as shown in FIG. 13B may be adopted. The film antenna 60 has antenna elements 61, 62 which have the same trapezoidal shape (substantial isosceles trapezoid or isosceles trapezoid) and are respectively turned upside down. The antenna elements 61, 62 are disposed so that the feed point 30A is located therebetween.

A film antenna 70 as shown in FIG. 13C may be adopted. The film antenna 70 has antenna elements 71, 72 which have the same trapezoidal shape (substantial isosceles trapezoid or isosceles trapezoid) and are mutually opposite to each other in the vertical direction. The antenna elements 71, 72 are disposed so that the feed point 30A is located therebetween. At the feed point 30A side, the end portions of the antenna elements 71, 72 are separated from each other in the vertical direction, so that the interval therebetween can be easily set.

Furthermore, a film antenna 80 as shown in FIG. 13D may be adopted. The film antenna 80 has triangular antenna elements 81, 82 having the same shape and curved lines. The antenna elements 81, 82 are disposed so that the feed point 330A is located therebetween.

A film antenna 90 as shown in FIG. 13E may be adopted. The film antenna 90 has antenna elements 91, 92 which have the same shape and are designed in a mirrored-image parallelogram shape. The antenna elements 91, 92 are disposed so that the feed point 30A is located therebetween.

Furthermore, a film antenna 100 as shown in FIG. 13F may be adopted. The film antenna 100 has antenna elements 101, 102 having the same parallelogram. The antenna elements 101, 102 are disposed so that the feed point 30A is located therebetween. At the feed point 30A, the end portions of the antenna elements 101, 102 are separated from each other in the vertical direction, and thus the interval therebetween can be easily set.

Each of the two antenna elements of the film antenna is not limited to the examples shown in FIGS. 13A to 13F if a shape of each of the antenna elements is a shape in which two edges (end faces) from the feed point to the tip have two different resonance lengths or a shape in which an edge (end face) and the diagonal line from the feed point to the tip have two different resonance lengths. The two antenna elements of the film antenna may have the same shape or different shapes, and it may be any one of a triangle, a trapezoid, a parallelogram, a figure containing a straight line(s) and a curved line(s) and other figures.

According to this modification, the same effect as the above embodiment can be attained, and the film antenna whose shape meets the installation place can be implemented.

Furthermore, as in the case of the above embodiment, it is preferable that the feed points of the two antenna elements of the film antenna are separated from each other in the vertical direction, each of the antenna elements has the overlap portion at a position of the feed point, and the longitudinal direction of the two antenna elements is vertical to the direction of connecting the two overlap portions. In this construction, the longitudinal direction of the two antenna elements is vertical to the axial direction of the coaxial cable, and the coaxial cable can be connected to the film antenna. Accordingly, the film antenna can be easily manufactured to thereby increase the manufacturing efficiency, and the manufacturing dispersion can be reduced.

The description of the above embodiment and the modification relates to examples of the film antenna and the electronic equipment according to the present invention, and thus the present invention is not limited to these examples.

In the above embodiment and the modification, the handy terminal is used as electronic equipment. However, PDA, other electronic equipment may be used.

Further, various exemplary embodiments have been shown and described, the invention is not limited to the embodiments shown. Therefore, the scope of the invention is intended to be limited solely by the scope of claims that follow.

The entire disclosure of Japanese Patent Application No. 2007-131729 filed on May 17, 2007, including description, claims, drawings, and summary are incorporated herein by reference in its entirety.

What is claimed is:

1. A film antenna comprising:

a base film comprising an insulating material;

first and second antenna elements comprising film-like electric conductors formed on the base film; and an insulating protection sheet provided on the first and second antenna elements, wherein:

each of the first and second antenna elements has one of (i) a planar shape in which two end faces from a feed point to a tip have two different lengths, or (ii) a planar shape in which an end face and a diagonal line from a feed point to a tip have two different lengths, a core wire of a coaxial cable is connected to the first antenna element at the feed point, an external conductor of the coaxial cable is connected to the second antenna element at the feed point, the first and second antenna elements include an area as a capacitor for performing impedance matching, and the insulating protection sheet comprises a hole portion disposed at a position of the feed point for soldering connection between the first and second antenna elements and the coaxial cable.

2. The film antenna according to claim 1, further comprising a dielectric sheet attached to at least one of a surface side of the first and second antenna elements on the base film and a back surface side of the base film.

3. The film antenna according to claim 1, wherein the first and second antenna elements include overlap portions corresponding to the respective feed point positions disposed on a line vertical to the longitudinal direction of the first and second antenna elements.

4. The film antenna according to claim 1, wherein the base film comprises polyimide.

5. The film antenna according to claim 1, wherein the first and second antenna elements comprise copper foil.

6. The film antenna according to claim 1, wherein each of the first and second antenna elements is shaped as one of a triangle, a trapezoid, a parallelogram, and a figure containing a straight line and a curved line.

7. An electronic equipment comprising:

the film antenna according to claim 1;

a communication unit that performs communication with an external equipment through the film antenna; and a control unit that controls the communication of the communication unit using the film antenna.

8. A film antenna comprising:

a base film comprising an insulating material; and first and second antenna elements comprising film-like electric conductors formed on the base film;

wherein:

each of the first and second antenna elements has one of (i) a planar shape in which two end faces from a feed point to a tip have two different lengths, or (ii) a planar shape in which an end face and a diagonal line from a feed point to a tip have two different lengths, a core wire of a coaxial cable is connected to the first antenna element at the feed point, an external conductor of the coaxial cable is connected to the second antenna element at the feed point, the first and second antenna elements include an area as a capacitor for performing impedance matching, and a length in a longitudinal direction of the first antenna element is shorter than a length in a longitudinal direction of the second antenna element by an amount corresponding to a length in an axial direction of a bared insulating portion between the core wire and the external conductor of the coaxial cable.

9. The film antenna according to claim 8, further comprising a dielectric sheet attached to at least one of a surface side of the first and second antenna elements on the base film and a back surface side of the base film.

10. The film antenna according to claim 8, wherein the first and second antenna elements include overlap portions corresponding to the respective feed point positions disposed on a line vertical to the longitudinal direction of the first and second antenna elements.

11. The film antenna according to claim 8, wherein the base film comprises polyimide.

12. The film antenna according to claim 8, wherein the first and second antenna elements comprise copper foil.

13. The film antenna according to claim 8, wherein each of the first and second antenna elements is shaped as one of a triangle, a trapezoid, a parallelogram, and a figure containing a straight line and a curved line.

14. An electronic equipment comprising:

the film antenna according to claim 8;

a communication unit that performs communication with an external equipment through the film antenna; and a control unit that controls the communication of the communication unit using the film antenna.

* * * * *